United States Patent [19]

Joseph et al.

[11] Patent Number: 4,884,105

[45] Date of Patent: Nov. 28, 1989

[54] REPRODUCTION APPARATUS HAVING A SPROCKET-DRIVEN TRANSFER DRUM

[75] Inventors: Brian J. Joseph, Rochester; Leo G. Procter, Churchville; Carl W. Roy, Spencerport, all of N.Y.

[73] Assignee: Eastman Kodak Co., Rochester, N.Y.

[21] Appl. No.: 239,882

[22] Filed: Sep. 2, 1988

[51] Int. Cl.[4] ..... G03G 15/00; G03G 15/01

[52] U.S. Cl. ..... 355/212; 355/213; 355/271; 355/327

[58] Field of Search ..... 355/212, 213, 271, 277, 355/327, 326

[56] References Cited

U.S. PATENT DOCUMENTS

| | | | |
|---|---|---|---|
| 3,914,047 | 10/1975 | Hunt, Jr. et al. | 355/212 |
| 4,407,580 | 10/1983 | Hashimoto et al. . | |
| 4,531,828 | 7/1985 | Hoshino | 355/327 X |
| 4,705,386 | 11/1987 | Ogita et al. | 355/327 |
| 4,712,906 | 12/1987 | Bothner et al. | 355/271 |
| 4,724,458 | 2/1988 | Roy et al. . | |

*Primary Examiner*—A. C. Prescott
*Assistant Examiner*—Barry J. Shapiro
*Attorney, Agent, or Firm*—Leonard W. Treash

[57] ABSTRACT

A reproduction apparatus includes a mechanism for transporting a web carrying electrostatically held toner images through an endless path. The web includes a plurality of closely spaced perforations along an edge. A transfer device includes a drum for presenting a receiving surface to the web to receive a plurality of images in registery, for example, color separation images that will make up a multicolor image on the receiving surface. The transfer drum is driven through a gear train by a sprocket which engages the perforations. The sprocket may also drive the web. To assure the most accurate registry despite inaccuracies in the gear train or perforation location, the pitch of the images on the web divided by the circumference of the sprocket is an integer, preferably 1 and preferably, the circumference of the sprocket divided by the circumference of each of the gears in the gear train is an integer.

9 Claims, 2 Drawing Sheets

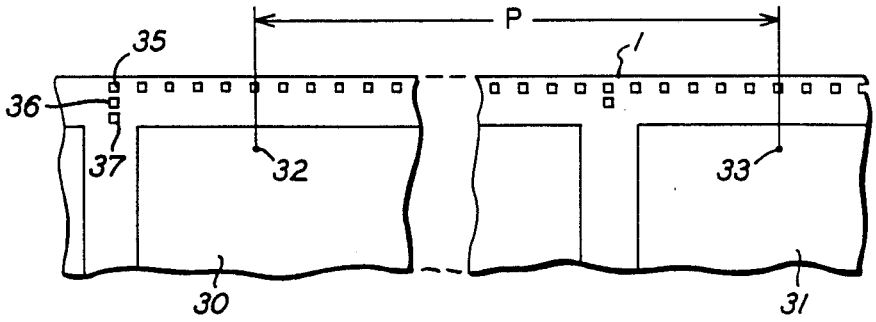
FIG. 2
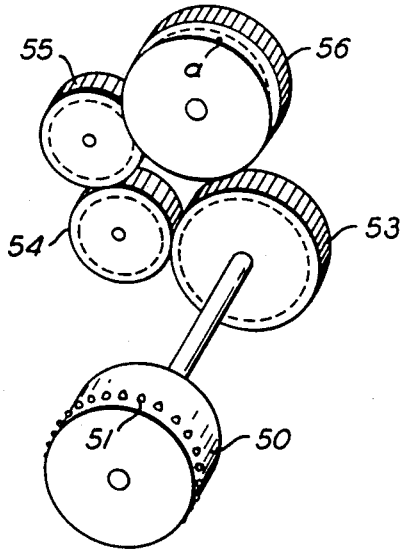
FIG. 3
FIG. 4
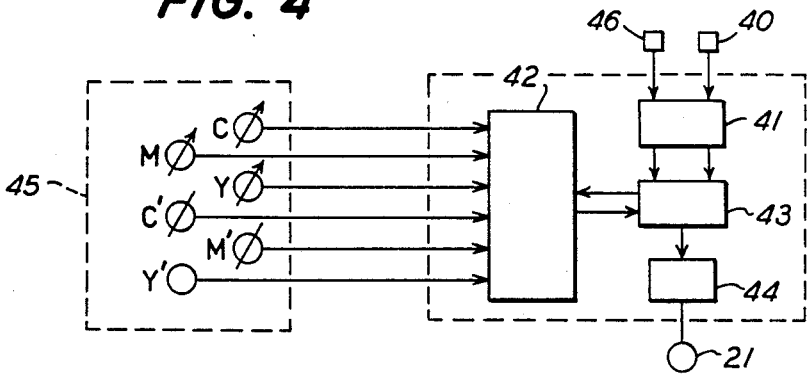

REPRODUCTION APPARATUS HAVING A SPROCKET-DRIVEN TRANSFER DRUM

CROSS-REFERENCE TO RELATED APPLICATIONS

This application is related to copending U.S. patent application Ser. No. 239,885, filed Sept. 2, 1988, in the name of Calvin E. Harris, titled MULTI-IMAGE REPRODUCTION APPARATUS.

TECHNICAL FIELD

This invention relates to electrostatic reproduction apparatus of the type in which a plurality of images carried by a single web are transferred in registry to a single receiving surface.

BACKGROUND ART

U.S. Pat. No. 4,724,458 granted Feb. 9, 1988 to Roy et al, shows a color reproduction apparatus in which consecutive electrostatically held toner images are superimposed at a transfer station. The electrostatically held images are carried on an endless belt. The transfer station includes a drum which carries a receiving sheet on its periphery with the intended receiving surface exposed. The drum is driven so that the receiving surface moves at the same speed as the belt by gearing between a sprocket driven by the belt and the drum.

When used to produce a high quality color image in which toners are combined to produce intermediate colors, the quality of the image is dependent upon the accuracy of registration of those images. Even very slight misregistration can change the perceived hue of the image as well as its sharpness. Because the web carries the images to be transferred consecutively and the web has the tendency to follow itself in the same path for at least three or four images, crosstrack registration is not generally a source of substantial misregistration. However, utilizing structure shown in FIG. 8 of the Roy patent, intrack registration is very much dependent upon the preciseness of the sprocket and gear train. That FIG. 8 structure shows a sprocket gear coaxial with and driven with the sprocket, and two intermediate gears transmitting the drive from the sprocket gear to a drum gear which is coaxial with and driven with the drum. Although that structure gives reasonably good results for most applications, even close attention to precision in the manufacture of the gearing does not yield the highest quality of registration.

DISCLOSURE OF THE INVENTION

It is the object of this invention to provide a multi-image reproduction apparatus generally of the type described but in which high quality registration is obtained with only ordinary preciseness in the manufacture of the drive train between the sprocket and the drum.

This and other objects are accomplished by a sprocket which has a circumference which when divided into the pitch, i.e., the distance between the points to be registered in the images is an integer.

According to a preferred embodiment, the circumference of the sprocket divided by the circumference of each of the gears in the gear train between the sprocket and the drum is also an integer.

With this construction, consecutive points in the image are controlled by the same gear teeth and sprocket teeth throughout the drive train. Any imprecision in the drive train is then repeated point for point in each image. Consecutive images then are laid down in registry and the imprecision would show up only as a slight change in length of an otherwise precise image. No loss of sharpness or hue occurs and the change in length is imperceptable.

BRIEF DESCRIPTION OF THE DRAWINGS

FIG. 2 is a top view of an edge of an endless web usable in the apparatus shown in FIG. 1.

FIG. 3 is a perspective view of a drive train of a transfer apparatus shown as part of the apparatus in FIG. 1.

FIG. 4 is a schematic circuit diagram of the flash actuation circuitry for the apparatus shown in FIG. 1.

BEST MODE OF CARRYING OUT THE INVENTION

Figure 1:
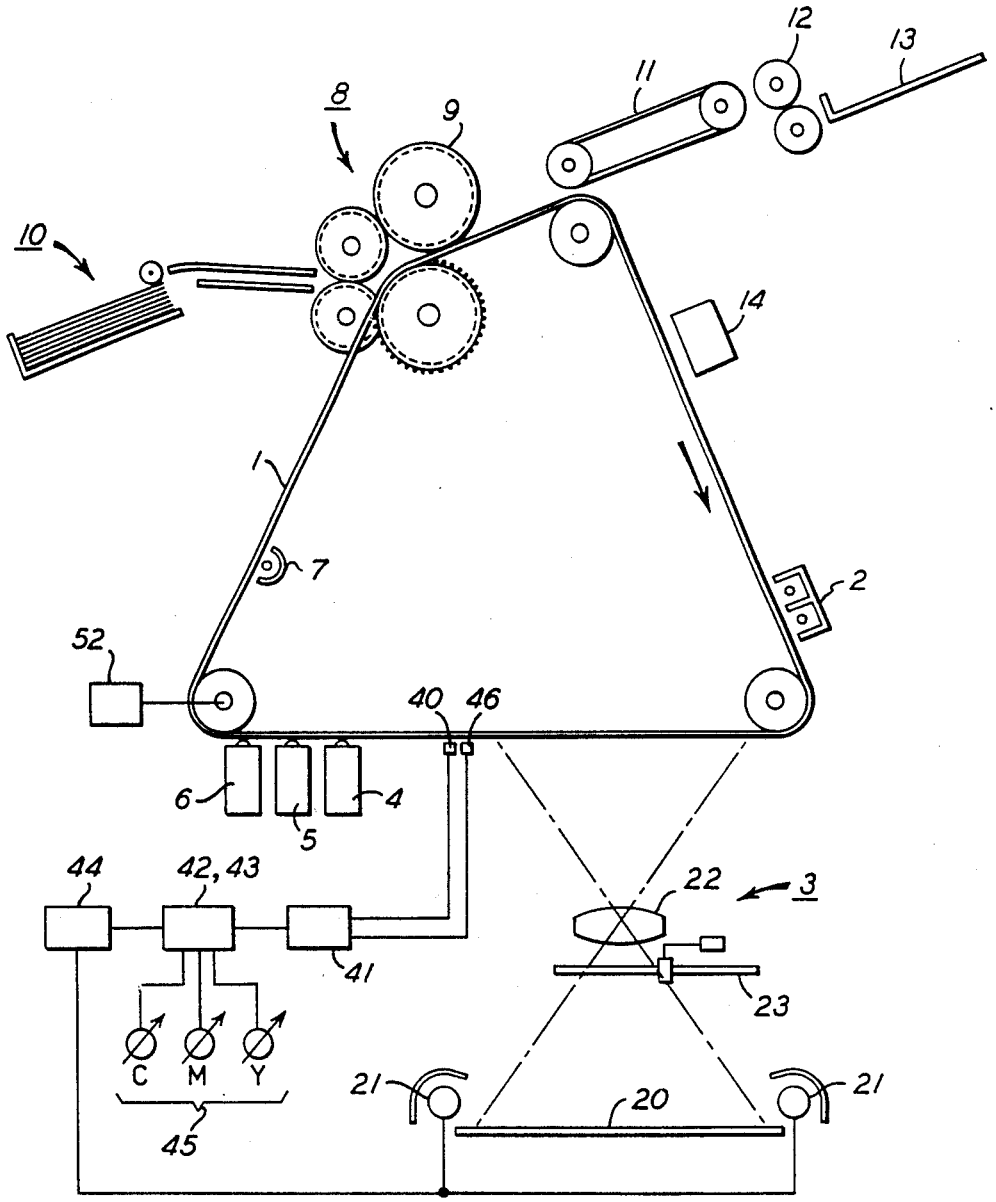
FIG. 1 is a schematic side view of a color electrophotographic apparatus constructed according to the invention.

According to FIG. 1 an electrophotosensitive web 1 is trained about a series of rollers to move through an endless path. Although the construction of the web can take various forms, conventionally it contains one or more photoconductive layers, a conductive layer and a suitable support.

The web is driven by a motor 52 and transported through operative relation with a series of stations to form multicolor reproductions on a receiving sheet. More specifically, the web is uniformly charged at a charging station 2, consecutive image areas (discussed in more detail below) are exposed to color separation images of an original at an exposure station 3 to form electrostatic latent images representative of the color separations, and the images are toned by appropriate colored toners at toning stations 4, 5 and 6 as is well known in the art.

Some of the forces holding the oner to the web 1 are eliminated by an erase lamp 7. The toner images then proceed to a transfer device 8 where they are transferred in registry to a receiving surface to form a multicolor image. More specifically, a receiving sheet is fed from a receiving sheet supply 10 to the transfer device 8 where the sheet is held on the periphery of a transfer drum 9. The transfer drum 9 is rotated at a speed bringing a receiving surface of the receiving sheet into repeated transfer relation with the toner images to transfer consecutive toner images in registry to the receiving surface of the receiving sheet. After the desired number of toner images have been transferred to the receiving surface the receiving sheet is separated from or no longer held by the transfer drum 9 and follows the web 1 until picked off by a receiving sheet transport mechanism 11 which transports it to a roller fuser 12 and hence to an output hopper 13. The web 1 is then cleaned at a cleaning station 14 for reuse. This general process as described is well known in the art and utilized by apparatus available commercially.

One of the critical aspects in forming multicolor reproductions of color originals using this apparatus is the preciseness of the registration of the toner images on the receiving surface. With the apparatus shown in FIG. 1 this registration is dependent primarily upon two stations, the exposure station and the transfer station. A given point on the receiving surface, as it is rotated by transfer drum 9 into transfer relation with the toner images, must receive toner from the same points in the consecutive images. If these points in consecutive images are off by even as much as .001 inches, the resulting multicolor image will appear less sharp, and in instances where a color is obtained by combining two or more toners at the same point, there will be a noticeable change in hue.

The exposure station is similar to that shown in U.S. Pat. No. 4,477,176 Russel. A color original 20 is illuminated at an exposure position by flash lamps 21. A color separation of the original is projected by a lens 22 onto the charged web 1. Color separation is provided by a filter wheel 23, as is known in the art.

Referring to FIG. 2 the web 1 is divided into discrete image areas 30, which are not necessarily physically defined. Although an individual color separation image need not be placed at a specific place in any image area 30, it is important that the pitch of the latent images be consistent with the pitch of the rotating receiving surface associated with transfer drum 9. For example, if a point in the original is imaged on consecutive image areas 30 and 31 as points 32 and 33, toner applied at those two points at the toner stations must be transferred to the same point on the receiving surface associated with transfer drum 9. The distance between the points 32 and 33 on the web 1 is the pitch P of the two images.

U.S. Pat. Nos. 3,914,047 and 4,025,186 both to Hunt, et al are representative of a number of references which show timing flash exposure using timing marks for perforations on a web. Somewhat similar to those prior systems, web 1 as shown in FIG. 2 contains sprocket perforations 35 and flash perforations 36, and a single master perforation 37. A flash perf sensor 40 (FIG. 1) senses the flash perforations and a master perf sensor 46 senses the master perforation. The sprocket perforations may also be sensed. In general, the information derived from sensing the flash and master perforations is fed into appropriate circuitry which combines that information with its own timing circuitry and actuates the flash lamps 21 at the appropriate time to create the electrostatic latent image at the desired place in the image areas. Using this information the apparatus will also control other functions of the apparatus, including actuation of the toner stations 4, 5 and 6, feeding of the receiving sheet from receiving sheet supply 10, separation of the receiving sheet from the transfer drum, and the like.

Referring to FIG. 4 the circuitry associated with flashing the lamps 21 in response to sensing flash and master perforations is shown. Sensors 40 and 46 can be optical sensors for sensing the leading or trailing edge of a perforation, mechanical sensors as shown in the Hunt, et al patents referred to above or any other suitable sensor for sensing indicia on a web. The sensor is actuated by the perforation, preferably an edge of the perforation, passing a given point thereby creating a signal which is amplified and processed by a signal conditioning amplifier 41 and fed to microprocessor using interrupt and multiplexing logic 43. Microprocessor 43 then controls actuation of flash lamps 21 through a flash illumination power supply 44. A delay is built into the system by connecting a multiplexing and delay timing circuit 42 to microprocessor 43.

In a perfect system, a fixed time after the sensing of each flash perforation, the flash lamps 21 are illuminated to create an electrostatic latent image in one of the image areas. This system is accurate enough for monocolor reproduction where slight variations in the location of the image on the final transfer surface are not noticeable to the human eye. However, in color systems in which consecutive images are to be placed in registry on the transfer surface, much greater accuracy is required for highest quality work. With ordinary film manufacturing processes, adequate for most photographic purposes, placement of the flash perforations is not accurate enough to give the highest quality color reproduction.

This problem has been solved in the apparatus shown in FIG. 1 by permitting the service person to adjust the delay between the sensing of the flash perforations and actuation of the flash lamps 21 separately for each image area on the web 1. This adjustment may be accomplished by a mechanical mechanism, knobs, set screws or the like which control the settings on real time delay adjusting potentiometers 45 in FIGS. 1 and 4. In turn, timing circuit 42 is adjustable by the potentiometers 45. In essence, a flash perforation is sensed by sensor 40 and the flash lamp 21 is actuated after a delay controlled by circuit 42 as adjusted for each flash perforation by potentiometers 45. In order to relate the potentiometers to a particular frame and thereby to a particular color, input from master perf sensor 46 is also fed to microprocessor 43. This input permits the logic and control circuitry to maintain each frame dedicated to a particular potentiometer for adjustment.

In doing color reproduction work of this type, using three colors, the toners are generally of the cyan, magenta and yellow color and are applied to electrostatic images formed through red, green and blue filters respectively.

Referring to FIG. 4 and assuming filter wheel 23 to have red, green and blue filters to control the projection of comparable separation images on the web 1, and assuming that the web 1 is of a length to accommodate six image areas, six separate adjustment devices are provided. As shown in FIG. 4, they are labeled C, M, Y, C', M' and Y'.

In operation, a service person replaces an old web with a new web in the apparatus shown in FIG. 1. Using a color test target, reproductions are made with the adjustment means 45 at a particular value, for example, each flash may be set to occur, say, 200 milliseconds after sensing each flash perforation.

The resulting reproductions are examined. This examination may include use of appropriate magnifiers to determine the registration of the images produced. If one or more of the color components making up the final multicolor image appears to be separated from the other components, the service person adjusts the appropriate set screw in adjustment means 45. For example, if a color reproduction made using the first three image areas following the master perforation shows the cyan-colored image and the yellow colored image in good registration but the magenta image slightly ahead of the other two images, the set screw noted as M in adjustment means 45 is adjusted to lengthen the time between sensing of the appropriate flash perforation and the flash for the green color separation exposure.

The second series of set screws C', M' and Y' can also be adjusted accordingly using a second color reproduction made with the fourth, fifth and sixth image areas.

In theory, it is not necessary that a specific color be associated with a specific image area. The set screws could be numbered 1 through 6, one for each image frame (denoting the image frames, in order, after the master perforation) since they are basically adjusted only for variations in the location of the flash perforations. However, it is easier for the service person to recognize which set screws should be adjusted if the set screws and, therefore, the image areas are dedicated to a particular color. More complicated systems are possible. For example, a four color system, cyan, magenta, yellow and black, may also use a six image area web. One approach to proper adjustment in this instance, is to operate the apparatus as a three color apparatus during the set up. Once the set screws are fine tuned for each flash perforation, the apparatus is indifferent to what color images and toners are used with any particular image area. Obviously, other schemes could be used for setting the potentiometers 45.

The flash perforations make programming the microprocessor easier. However, the sprocket perforations alone could be used with the master perforation to accomplish the result desired. Essentially, microprocessor 42 would count sprocket perforations with respect to the master perforation, utilizing one of the sprocket perforations in each image area essentially as a flash perforation. Also, other indicia may be used that can be sensed by the apparatus, for example, optically sensible marks, electrically sensible variations in conductivity or magnetically sensible magnetic indicia.

Although this system is described using a timing delay circuit for measuring the delay imposed on the flash actuation circuit, the approach can also work from an encoder (not shown) which monitors the angular position of one of the rollers. In this alternative, the delay is in terms of encoder pulses and is not strictly a time but is a length of web after the flash perf is sensed.

Assuming that the toned color images leaving toner stations 4, 5 and 6 have the proper pitch, the transfer drum 9 must still be rotated properly to assure that each point on the receiving surface receives comparable points from each toner image. U.S. Pat. No. 4,724,458 to Roy et al shows a mechanism in which the transfer drum 9 is driven by a sprocket which engages sprocket perforations in an electrophotosensitive web. The sprocket drives the tranfer drum through a gear train including a drum gear coaxial with the transfer drum and a sprocket gear coaxial with the sprocket and two intermediate gears. However, it was found that great preciseness was required in the gearing to assure that the transfer drum brought the same point on the receiving surface back to the comparable points on the respective toner images. This need for preciseness has been cured in this apparatus by careful choice of sprocket and gearing sizes. Referring to FIG. 3, a sprocket 50 includes teeth 51 which engage sprocket perforations 35 in web 1. Sprocket 50 is driven by web 1 maintaining contact between teeth 51 and the trailing edge of sprocket perforations 35. Sprocket 50 also drives transfer drum 9 through a gear train that includes a sprocket gear 53 coaxial with and driven with and by sprocket 50, two intermediate gears 54 and 55, and a drum gear 56 coaxial with and driven with drum 9.

Sprocket 50 and gears 53, 54, 55 and 56 are sized to assure that the same teeth in each component are supplying the driving force for rotating transfer drum 9 for comparable points in successive images. Preferably, sprocket 50 has a circumference effectively equal to the pitch P of the images as described with respect to FIG. 2. Similarly, each of gears 54 and 55 have circumferences which when divided into the circumference of sprocket 50 give an integer. For example, if the pitch of the images is 51 sprocket perforations over, say 300 millimeters, sprocket 50 should have 51 teeth and have an effective circumference of 300 millimeters. Gear 53 would also have the same 300 millimeter circumference and can have any number of teeth, say 66 teeth. Intermediate gears 54 and 55 can be made one-half the size of gear 53, having an effective circumference of 150 millimeters each and 33 teeth. Gear 56 must have the same circumference as transfer drum 9 which of necessity is equal to the pitch of the images and, therefore, gear 56 is 300 millimeters in circumference and has 66 teeth. With this transfer device constructed accordingly, each point on the receiving surface will be driven by the same teeth throughout the gear train and the sprocket for each image being transferred. Thus, if there is any imprecision in any tooth in any of the gears, that imprecision will be repeated at the same place in the transfer process for each image. Although a slight distortion in the length of the document may occur at that point, there will be no distortion in image sharpness or hue as a result of the respective images not coinciding. The slight distortion in length of an otherwise high quality color image is not noticeable.

Thus, the resulting color reproduction can be of very high quality without the expense of extremely precise drive gearing between the sprocket and the transfer drum.

The web 1 can drive the sprocket 50 as shown with the teeth 51 engaging the trailing edge of the sprocket perforations 35. Alternatively, the web 1 can be driven by the sprocket 50 with the teeth 51 engaging the leading edges of the perforations 35.

The apparatus shown in FIG. 1 need not be of the type which a transfer sheet is secured to the surface of the transfer drum 9. Other systems are known in which three or four consecutive color images are transferred directly to the surface of drum 9 to form a multicolor image on the surface which is then retransferred to a transfer sheet at a position either remote from the transfer drum-web nip or at the nip itself. The registration features disclosed herein are usable with such systems. Similarly, the transfer drum may be of a size large enough to hold two multicolor images on its surface or on the surface of two receiving sheets; see, for example, U.S. Pat. No. 4,712,906 to Bothner et al. These registration systems could be used with such apparatus, the pitch of the images then being consecutive pairs of images rather than consecutive images.

While the invention has been described in connection with a preferred embodiment thereof, it will be understood that variations and modifications can be effected within the spirit and scope of the invention as described hereinabove and as defined in the appended claims.

We claim:

1. A multi-image reproduction apparatus of the type including means for transporting a web carrying electrostatically held toner images through an endless path, which web includes a plurality of closely spaced perforations along an edge thereof, and a transfer device for transferring a plurality of such images in registry to a receiving surface to form a composite image, which transfer device includes a transfer drum rotatable to bring the receiving surface into transfer relation with said images once for each image to be transferred, a sprocket engageable with the perforations in the web and rotatable with the movement of the web, gear means between the sprocket and the transfer drum to rotate the transfer drum at a peripheral speed coordinated with the speed of the web to permit said images to be transferred in registry, characterized in that the distance between points to be registered in the images divided by the circumference of the sprocket is an integer and the circumference of the sprocket divided by the circumference of each of said gears is an integer.

2. A multicolor reproduction apparatus of the type including means for transporting a web carrying electrostatically held toner images through a path, which web includes a plurality of closely spaced perforations along an edge thereof, and a transfer device for transferring a plurality of such images of different color in registry to a receiving surface to form a composite multicolor image, which transfer device includes a transfer drum rotatable to bring the receiving surface into transfer relation with said images once for each image to be transferred, a sprocket engageable with the perforations in the web, rotatable with the movement of the web and coupled to the transfer drum to rotate the transfer drum at a peripheral speed coordinated with the speed of the web to permit said images to be transferred in registry.

characterized in that the distance on the web between image points to be registered divided by the circumference of the sprocket is an integer.

3. An apparatus according to claim 2 wherein said transfer device further includes at least two intermediate gears coupling said sprocket and said transfer drum, which intermediate gears each have a circumference such that the circumference of said sprocket is an integer multiple of the circumference of each of said intermediate gears.

4. An apparatus according to claim 2 wherein said sprocket and said drum have the same circumference.

5. An apparatus according to claim 2 wherein said transfer drum includes means for holding a receiving sheet, one surface of which is the receiving surface for receiving the images in registry.

6. An apparatus according to claim 2 wherein said transfer drum has an outer surface which constitutes the receiving surface for receiving the images in registry.

7. A multicolor reproduction apparatus of the type including means for transporting a web carrying electrostatically held toner images of different color through an endless path, which web includes a plurality of closely spaced perforations along an edge thereof, and a transfer device for transferring a plurality of such images in registry to a receiving surface to form a composite image, said transfer device comprising:

a transfer drum including means for holding a receiving sheet on the outer periphery thereof and rotatable to bring a receiving surface of said sheet into transfer relation with said images once for each image to be transferred, a sprocket having a circumference equal to the pitch of said images on said web and engageable with the perforations in the web and rotatable with the movement of the web, and gear means between the sprocket and the transfer drum to rotate the transfer drum at a peripheral speed substantially equal to the speed of the web to permit said images to be transferred in registry, said gear means including a sprocket gear coaxial with, driven with and of equal circumference with the sprocket and a drum gear coaxial with, driven with and of equal circumference with the transfer drum and two intermediate gears coupling the sprocket gear and the drum gear, said intermediate gears each being one half the circumference of the sprocket and drum gears.

8. A multicolor reproduction apparatus of the type including means for transporting a web carrying electrostatically held toner images of different colors through a path, which web includes a plurality of closely spaced perforations along an edge thereof, with a fixed number of perforations between comparable points in consecutive images, and a transfer device for transferring a plurality of such images of different color in registry to a receiving surface to form a composite multicolor image, which transfer device includes a transfer drum rotatable to bring the receiving surface into transfer relation with said images once for each image to be transferred, a sprocket engageable with the perforations in the web, rotatable with the web and coupled to the transfer drum to rotate the transfer drum at a peripheral speed coordinated with the speed of the web to permit said images to be transferred in registry, said sprocket having teeth around its periphery equal in number to said fixed number of perforations between comparable points in consecutive images, so that said sprocket turns once for each image.

9. Apparatus according to claim 8 including a sprocket gear rotatable with said sprocket and having a predetermined number of teeth, a drum gear rotatable with said drum and also having a predetermined number of teeth, and intermediate gears coupling said sprocket gear and said drum gear and each having a predetermined number of teeth, said sprocket gear and drum gear having the same number of teeth and the number of teeth of each intermediate gear, when divided into the number of teeth in the sprocket gear and drum gear is an integer.

* * * * *